US008966951B2

(12) United States Patent
Cronier et al.

(10) Patent No.: US 8,966,951 B2
(45) Date of Patent: Mar. 3, 2015

(54) SPRAYING METHOD AND DEVICE FOR A ROLLING PLANT

(75) Inventors: Vincent Cronier, La Ricamarie (FR); Bernard Rossigneux, Lezigneux (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 883 days.

(21) Appl. No.: 13/146,696

(22) PCT Filed: Feb. 2, 2009

(86) PCT No.: PCT/FR2009/000113

§ 371 (c)(1),
(2), (4) Date: Jul. 28, 2011

(87) PCT Pub. No.: WO2010/086514

PCT Pub. Date: Aug. 5, 2010

(65) Prior Publication Data

US 2011/0278367 A1 Nov. 17, 2011

(51) Int. Cl.

| | |
|---|---|
| ***B21B 27/10*** | (2006.01) |
| ***B21B 13/14*** | (2006.01) |
| *B21B 13/02* | (2006.01) |

(52) U.S. Cl.

CPC ..... *B21B 27/10* (2013.01); *B21B 13/145* (2013.01); *B21B 2013/028* (2013.01)

USPC ..... 72/236; 72/201; 72/243.2; 72/243.4

(58) Field of Classification Search

CPC ..... B21B 13/14; B21B 13/145; B21B 27/06; B21B 27/10

USPC ..... 72/201, 236, 242.2, 242.4, 243.2, 72/243.4, 342.2, 342.3

See application file for complete search history.

(56) References Cited

U.S. PATENT DOCUMENTS

| | | | | |
|---|---|---|---|---|
| 2,085,449 | A * | 6/1937 | Rohn | 72/201 |
| 3,214,952 | A * | 11/1965 | Eckert | 72/201 |
| 3,277,686 | A * | 10/1966 | James et al. | 72/201 |
| 3,998,084 | A * | 12/1976 | Rerecich | 72/201 |

(Continued)

FOREIGN PATENT DOCUMENTS

| | | |
|---|---|---|
| CN | 2542353 Y | 4/2003 |
| EP | 1 118 395 B1 | 7/2005 |

(Continued)

*Primary Examiner* — Edward Tolan

(74) *Attorney, Agent, or Firm* — Laurence A. Greenberg; Werner H. Stemer; Ralph E. Locher

(57) ABSTRACT

A spraying method and device for a plant for rolling a strip, the plant having at least one rolling stand. The device includes: a pair of working rolls between which the strip runs; a plane perpendicular to the running direction of the strip; at least one pair of supporting rolls for the working rolls; two pairs of bearing rolls, each of the pairs having the rolls thereof substantially symmetrically arranged on either side of the working rolls in a plane substantially parallel to the strip so as to transfer, to the working rolls, a force for maintaining the working rolls in a predetermined position relative to the supporting roll; a support for the bearing rolls in the form of two rows including a plurality of bearing rollers mounted side by side; one or more nozzle systems for spraying at least a portion of the strip and at least a portion of the rolls. At least one of the nozzle systems is capable of directly spraying at least a portion of the working rolls on either side of the plane that is perpendicular to the running direction of the strip.

24 Claims, 5 Drawing Sheets

(56) References Cited

U.S. PATENT DOCUMENTS

| | | | | | |
|---|---|---|---|---|---|
| 4,247,047 | A | * | 1/1981 | Schaming | 239/391 |
| 4,324,122 | A | * | 4/1982 | Urban | 72/41 |
| 4,531,394 | A | | 7/1985 | Turley et al. | |
| 4,552,008 | A | * | 11/1985 | Schlatter et al. | 72/201 |
| 4,631,948 | A | * | 12/1986 | Bald et al. | 72/243.4 |
| 4,671,091 | A | * | 6/1987 | Atack et al. | 72/45 |
| 6,490,903 | B2 | | 12/2002 | Ravenet et al. | |
| 6,494,954 | B1 | * | 12/2002 | Bernert et al. | 118/314 |
| 7,185,522 | B2 | | 3/2007 | Turley | |

FOREIGN PATENT DOCUMENTS

| | | | |
|---|---|---|---|
| EP | 1 721 685 | A1 | 11/2006 |
| JP | 58-148006 | A | 9/1983 |
| JP | 2-274302 | A | 11/1990 |

* cited by examiner

SPRAYING METHOD AND DEVICE FOR A ROLLING PLANT

BACKGROUND OF THE INVENTION

Field of the Invention

This invention relates to a spraying method and device for a rolling plant for moving metal strips.

In particular, the invention relates to the lubrication and the cooling of the metal strip and elements related to the cold rolling of said strip in continuous or reversible movement in at least one rolling stand. Notably, said elements refer to a group of superposed rolls having parallel longitudinal axes that are placed substantially in at least one single plane perpendicular to the running direction of the strip. The longitudinal axis of one of said rolls is defined as an instant axis of rotation, parallel to a generatrix of the roll and passing through the center of mass of said roll.

A rolling plant for metal strip generally has at least one rolling stand fitted with at least two vertically superposed working rolls, each of which having its longitudinal axis of rotation parallel to the plane defined by the metal strip and placed in the same clamping plane substantially perpendicular to the running direction of the strip. When rolling, the working rolls are generally pressed against one another by a pair of support rolls having their longitudinal axes in said same clamping plane, and between which is applied a rolling pressure, or load. Such a rolling plant formed by four vertically superposed rolls, or two working rolls of lesser diameter associated with two support rolls of greater diameter is known as a "four-high mill". If two other intermediate rolls are interposed respectively between the working roll and the support roll, the rolling plant then comprises six vertically superposed rolls, i.e. a pair of working rolls, then a first pair of intermediate support rolls, and a second pair of final support rolls, and is usually known as a "six-high mill". Finally, a six-high mill can have side supports, i.e. each side of each of the working rolls is in contact with a side bearing roll itself supported by two rows of side bearing rollers assembled side to side. Six-high mills including said rolls and bearing rollers are generally known as side-supported six-high mills. In any case, the rolls bear on or against one another along the substantially parallel bearing lines directed according to a generatrix whose profile, normally rectilinear, depends on the loads applied and the resistance of the rolls. For rolls superposed in a plane perpendicular to the running direction of the strip, this means loads normal to the strip and, for side bearing rolls, lateral loads parallel/tangential to the strip that are applied to the working rolls by a tangential transmission force of a rolling torque from the intermediate support rolls.

In order to facilitate the movement of the strip between the working rolls, the gap in cold mills is lubricated. To do this, a lubricating fluid is sprayed onto the strip being rolled and the surface of the working rolls. In some cases, the spraying fluid also plays an important role in dissipating calories produced in the gap by the significant reduction in the strip and its plastic deformation. For example, the work related to the plastic deformation of the strip heats the working rolls to a temperature of around 100 to 150° C. Thus, although rolling occurs at ambient temperature in the case of cold rolling, the temperature in the roll gap of the working rolls increases considerably. This may cause the lubricating film to break resulting in seizing and/or a degradation of the surface quality of the rolled strip. Heating of the rolls, in particular the working rolls, is also liable to generate defects in the flatness and transversal profile of the strip through the non-uniform swelling of the diameter of the working roll along its length. It is therefore important that the spraying of the rolls and of the strip is optimal firstly to guarantee the formation and retention of a lubricating film contained between the contact surfaces of the working rolls with the strip, and secondly to ensure an efficient cooling of the strip and of the rolls. It is therefore common practice, in cold rolling, to cool the working rolls using a pressurized coolant spray. Generally, systems comprising spray nozzles make it possible to spray at least a part of the strip or a part of the rolls with said coolant spray.

Patent EP 1 118 395 B1 belonging to the applicant describes the issue with cold rolling, as well as the practical methods for adjusting the spraying rate of the width of the rolls in order to correct their expansion as a function of flatness measurements undertaken on the rolled strip. The method and the device described in patent EP 1 118 395 B1 makes it possible to cool and lubricate conventional four-high and six-high mills, but they are not effective for side-supported mills.

Indeed, in the case of a conventional four-high or six-high mill, the working rolls can be easily sprayed, on account of the excellent accessibility to the rolls, as shown in EP 1 118 395 B1. The problem is radically different for a side-supported six-high mill. Effectively, the design of side-supported mills is such that the space available between the side bearing members (i.e. the bearing rolls and the rollers) and the strip is very limited and prevents easy access to the working rolls in contact with the strip. A passing window for fluid jets typically measures 30 to 60 mm and may be as small as 10 mm. Furthermore, said side bearing members require a significant amount of lateral space and impose a distance between the spray nozzles and the working rolls of several hundreds of millimeters, for example 400 mm to 500 mm. Under these conditions, direct spraying of the working rolls is impossible. The person skilled in the art therefore always accepts very significant spraying of the strip, which carries a maximum amount of coolant to the roll gap of the rolls, as shown in document U.S. Pat. No. 4,531,394.

An improvement was proposed by document EP 1 721 685 A1 involving the removal of the side supports (i.e. side bearing rolls and rollers) from one side of the two working rolls in order to install, in their place, a spraying system whose nozzles are directly aimed at the working rolls. Such an arrangement is able to resolve the issue of cooling the rolls, but its applications are limited. Effectively, as specified in this document, application is strictly limited to mills running a stable rolling system, i.e. with a strip that causes no variation in transverse force torques that would be caused for example by butt welds of strips, and for a single running direction of the strip. In this case, the lateral loads applied to the working rolls by the tangential transmission force of the rolling torque from the intermediate rolls are assumed to always act in a single direction and the side supports are removed from the output side of the strip outside the roll gap. This arrangement cannot therefore be used in reversible mills where the running direction of the strip changes with each rolling pass, or in mills whose rolling systems vary sufficiently for the lateral loads on the working rolls to change direction.

BRIEF SUMMARY OF THE INVENTION

An object of the invention is to propose a method and a device for directly spraying both sides of the working rolls of a reversible or non-reversible mill, supported laterally. Both sides of the working roll correspond, during movement of the strip in one direction, to a first side of the roll facing the strip entering the roll gap of the working rolls and to a second side of the roll facing the strip leaving the roll gap of the working rolls.

For this purpose, a device and a method are proposed by the content of the claims.

On the basis of a spraying method adapted to a rolling plant of a moving metal strip comprising at least one reversible or non-reversible rolling stand, comprising:

- the rolling, by a pair of working rolls with parallel longitudinal axes, of said strip engaged between said working rolls and moving between said pair of working rolls along a plane of movement parallel to said longitudinal axes and in particular equidistant from these latter, each of said working rolls having at least one contact generatrix in contact with said strip,
- the transmission to the working rolls of a rolling load substantially normal to the strip and effecting said rolling of the strip, by a pair of support rolls with parallel longitudinal axes situated on either side of the strip, said support rolls and working rolls located on the same side of the strip being in contact with each other along a common support generatrix, i.e. belonging to the working roll and to the support roll, in order to transmit said rolling load,
- a plane perpendicular to one running direction of the strip, in which are located at least one of said contact generatrices and said longitudinal axes of said working rolls,
- the support of each of said working rolls by a pair of bearing rolls located, symmetrically or otherwise, on either side of said perpendicular plane, each of said bearing rolls being able to exert, along one bearing generatrix of said working roll, notably as a function of a running direction of the strip, a load keeping the longitudinal axis of said working roll in a determined position in relation to said rolling stand and to said bearing rolls,
- the spraying, in particular by the spraying of at least one jet of fluid, by at least one nozzle system of at least one part of the strip and at least one part of said working rolls, the method according to the invention is characterized by at least one direct spraying of at least one part of the working rolls, in particular on either side of said plane perpendicular to the running direction of the strip. In other words, the method according to the invention makes it possible among other things to directly spray a part of the roll that, on one side of the perpendicular plane, enters progressively in contact with said strip when it enters the roll gap and/or, on the other side of the perpendicular plane, progressively loses contact with said strip, and corresponding respectively to the side of the roll facing the incoming strip, and the side of the roll facing the outgoing strip.

More specifically, each working roll has two bearing generatrices, each associated with one of said support rolls on the same side of the strip as said working roll. Each of said bearing generatrices is defined as the generatrix of said working roll belonging to a half-plane extending from the longitudinal axis of said working roll and comprising the longitudinal axis of the bearing roll to which it is associated.

In particular, the spraying method according to the invention is characterized in that the spray is directed in an average direction substantially perpendicular to the axis of said working roll, or in an average direction substantially tangential to the axis of said working roll, or in a combination of average directions, perpendicular and substantially tangential to the axis of said working roll. Said average direction substantially tangential to the axis of said working roll is for example an average direction creating an angle of between 0° and 15° from the axis of said roll, such that the jet from a nozzle is able to spray the entire length of said working roll if said nozzle is placed at one of the two extremities of said working roll. Furthermore, average direction refers to the average of all the spraying directions taken by a jet coming from a spray nozzle. For example, if a nozzle jet has a straight conical shape whose point is occupied by the nozzle and whose base corresponds to a sprayed surface, the average direction of the jet shall be the axis from the point of the cone intercepting the center of the base of said cone. Advantageously, these different options for average spraying directions guarantee an optimal spraying of said working rolls regardless of the rolling conditions.

Furthermore, the method according to the invention is in particular characterized by the spraying, for at least one of said working rolls, of at least one part of a spraying surface defined, according to a first geometry, by a strip-surface half-plane extending from one of said contact generatrices and a surface of the working roll between this contact generatrix and one of said bearing generatrices, such that said spraying surface is contained within an acute dihedral formed by a first half-plane corresponding to said strip surface half-plane extending from said contact generatrix and a second half-plane extending from that same contact generatrix and comprising said bearing generatrix.

Moreover, the method according to the invention is also in particular characterized by the spraying, for at least one of said working rolls, of at least one part of a spraying surface defined, according to a second geometry, by a surface of said working roll contained within one of its bearing generatrices and its support generatrix. More generally, each of said working rolls has a support generatrix defined as the generatrix of said working roll belonging to a half-plane extending from the longitudinal axis of said working roll, not intercepting said strip, but including the longitudinal axis of the support roll that is on the same side of the strip as said working roll, such that said support generatrix is a generatrix common to said working roll and to said support roll in contact, along said support generatrix, with the working roll.

Advantageously, each working roll can therefore be sprayed along four different spraying surfaces including two surfaces defined according to said first geometry, i.e. limited by one of said contact generatrices and one or other of said bearing generatrices and two surfaces defined according to said second geometry, i.e. limited in this case by one or other of said bearing generatrices and said support generatrix. The working roll is therefore divided into four surfaces that can be sprayed independently or dependently on one another.

In particular, the method according to the invention is characterized by the simultaneous spraying of at least two of said spraying surfaces defined by at least one of said geometries.

Advantageously, according to a first spraying method, at least one part of all of the spraying surfaces defined according to said first geometry are sprayed simultaneously, either according to said spraying in an average direction perpendicular to the longitudinal axis of said working roll, or according to said spraying in an average direction substantially tangential to said generatrix of said working roll.

According to a second spraying method, at least one part of all of the spraying surfaces according to said first geometry being for the most part on the same side of said perpendicular plane are sprayed simultaneously, either according to said spraying in an average direction perpendicular to the longitudinal axis of said working roll, or according to said spraying in an average direction substantially tangential to said generatrix of said working roll. Advantageously, the second spraying method applies to continuous rolling, said sprayed part then being on the side of an entry of the rolled strip in the rolling stand.

According to a third spraying method, at least one part of all of the spraying surfaces defined according to said second geometry are sprayed simultaneously, either according to said spraying in an average direction perpendicular to the longitudinal axis of said working roll, or according to said spraying in an average direction substantially tangential to said generatrix of said working roll.

According to a fourth spraying method, at least one part of all of the surfaces defined according to said second geometry being for the most part on the same side of the perpendicular plane are sprayed simultaneously, either according to said spraying in an average direction perpendicular to the longitudinal axis of said working roll, or according to said spraying in an average direction substantially tangential to said generatrix of said working roll.

According to a fifth spraying method, at least one part of all of the spraying surfaces defined according to said first and said second geometry being for the most part on the same side of said perpendicular plane are sprayed simultaneously, either according to said spraying in an average direction perpendicular to the longitudinal axis of said working roll, or according to said spraying in an average direction substantially tangential to said generatrix of said working roll.

According to a sixth spraying method, at least one part of all of the spraying surfaces defined according to said first and said second geometry being for the most part on one side of said perpendicular plane, as well as at least one part of all of the surfaces defined according to said second geometry being for the most part on the other side of said perpendicular plane, are sprayed simultaneously, either according to said spraying in an average direction perpendicular to the longitudinal axis of said working roll, or according to said spraying in an average direction substantially tangential to said generatrix of said working roll.

Finally, according to a seventh spraying method, at least one part of all of the surfaces defined according to said first and said second geometry are sprayed simultaneously, either according to said spraying in an average direction perpendicular to the longitudinal axis of said working roll, or according to said spraying in an average direction substantially tangential to said generatrix of said working roll.

Moreover, the method according to the invention is characterized by an alternation of the spraying of said spraying surfaces defined according to at least one of said first or second geometries. Advantageously, the alternation of the spraying may be linked to the reversibility function of the rolling plant, such that when the strip moves in one direction, a first set of nozzles sprays at least one part of the surface of said working rolls according to a first spraying, then, when the running direction is reversed, the first set of nozzles stops spraying the strip and a second set of nozzles, substantially symmetrical to said first set of nozzles in relation to said perpendicular plane, sprays, according to a second spraying substantially symmetrical to said first spraying in relation to said perpendicular plane, said working rolls.

Furthermore, the method according to the invention is characterized by a variable spraying rate. Advantageously, said rate can vary over time for the same nozzle, or from one nozzle to another at a given instant, in particular, according to a position or a location of said nozzles. Non-exhaustively, this rate variation can be linked, for example, to a measurement of the flatness of the strip or of the temperature of one of said working rolls. This flatness measurement is in part linked for example to the heating of the roll or of the strip when reducing the thickness of the strip. Moreover, the flow rate of the nozzles can also vary in order to adapt to the quantity of energy used for the plastic deformation of the strip.

On the basis of a spraying device of a rolling plant of a moving metal strip comprising at least one reversible or non-reversible rolling stand, comprising:

- a pair of working rolls with parallel longitudinal axes between which said strip is engaged and moves, each one of said working rolls having at least one contact generatrix in contact with said strip,
- a plane perpendicular to one running direction of the strip, in which are located at least one of said contact generatrices and the axes of said working rolls,
- at least one pair of support rolls with longitudinal axes parallel to the rolling plane, defined by the strip and situated on either side of said strip, said support rolls and work rolls situated on the same side of the strip being in contact with each other along the common support generatrix in order to transmit to the working rolls, a rolling load substantially normal to the strip,
- two pairs of bearing rolls with parallel longitudinal axes, said bearing rolls of a given pair being located, symmetrically or otherwise, on either side of one of said working rolls relative to the perpendicular plane, in a plane parallel to the strip such that each of said bearing rolls of a given pair is able to transmit along a bearing generatrix of said working roll, and notably as a function of a running direction of the strip, a load enabling the axis of said working roll to be kept in a determined position relative to at least one of said support rolls,
- a support of said bearing rolls using two rows formed of a plurality of bearing rollers installed side by side, making it possible to keep said bearing rolls and working rolls in a determined position, said determined position being determined in relation to a movement of the bearing rollers relative to the reference of the rolling stand,
- at least one nozzle system enabling the spraying of at least one jet of fluid over at least one part of the strip and at least one part of one of said rolls, the device according to the invention is characterized in that at least one of said systems of nozzles is able to effect at least one direct spraying of at least one part of one of the working rolls, in particular on either side of said plane perpendicular to the running direction of the strip.

In particular, the device according to the invention is characterized in that said nozzle system is able to spray at least one part of one of said working rolls in an average direction substantially perpendicular to said axis of the working roll, or to spray one part of one surface of said working roll in an average direction substantially tangential to the axis of said working roll, i.e. forming for example an angle of between 0° and 15° in relation to the axis of said working roll or in relation to a part of said generatrices of said roll. Advantageously, the device according to the invention is able to combine said spraying in an average direction substantially perpendicular to the axis of one of said working rolls with said spraying in an average direction substantially tangential to the axis of one of said working rolls. The combination of these two average spraying directions guarantees an optimal spraying of said working rolls by guaranteeing a dynamic circulation of the fluid, and thus it improves the rolling quality of the strip.

In particular, the device according to the invention is characterized in that the nozzle system providing the spraying in an average direction substantially perpendicular to the axis of the working roll has a plurality of nozzles, arranged in line along the width of the strip, inserted between the bearing rollers, notably inserted level with a fixing of said rollers on a roller support. Advantageously, on account of this arrangement of the nozzles between the rollers, the distance to be covered by the jet to reach one of said working rolls is reduced from 400-500 mm to 200-250 mm. This reduction, in addition to the fact that it makes it possible to directly reach the surfaces of the working rolls with a jet of fluid without the jet of fluid being blocked by the bearing rollers, also has the advantage of more consistent jets ensuring a more powerful impact on the surface of said working rolls and thereby facilitating the heat exchange. Moreover, another advantage linked to the fact that the nozzles are mounted on the supports of said rollers is that said nozzles move simultaneously with said rollers as a function of the wear of the working rolls and therefore of the correlative movement of the supports of the rollers without having to adjust their positions.

Furthermore, the device according to the invention is in particular characterized in that said rollers have an active bearing surface comprising an external cylindrical surface of a sleeve made of hard material. In particular said sleeve made of hard material is made of steel and advantageously has a tubular shape, i.e. more specifically the shape of a straight hollow cylinder with or without internal recesses. Furthermore, each of said rollers has at least one bearing member able to enable a rotation of said roller around an axis of rotation passing through its center of mass and parallel to at least one generatrix of said external cylindrical surface of said roller. Advantageously, the positioning of said bearing members inside said rollers frees up a space between the rollers. Said space was occupied until now, i.e. in the prior art, by a member able to enable a rotation of the rollers, while advantageously, the device according to the invention uses this space to insert said nozzles enabling the spraying of said working rolls.

In particular, said axis of rotation is a fixed axis mounted on at least one roller support transmitting the lateral loads to at least one structure of said rolling stand. Thus, a fixing of the bearing rollers is provided by said fixed axis which completely crosses each of said rollers and is able to support each bearing member, such that each of said rollers is able to turn around said fixed axis. Furthermore, said fixed axis is fixed to said roller support at each of its two extremities. In particular, said fixed axis is either the same axis crossing through all of the rollers of the same line of rollers, while being supported by the roller supports between each roller, or is an axis specific to each roller such that each roller is crossed by its own fixed axis which is on each occasion fixed, at its extremities, to said roller support. Thus, said row of bearing rollers is made up of rollers, roller supports and either a single fixed axis, or a multitude of fixed axes, the number of which matches the number of rollers belonging to said row.

Furthermore and in particular, said sleeve of a roller receives, at each extremity of its internal cylindrical surface, at least one of said bearing members contained strictly within an internal straight cylinder volume formed by said internal cylindrical surface. Non-exhaustively, said bearing member is a ball or roller or needle assembly, protected or otherwise from the environment outside the roller by a system of at least one sealing gasket strictly contained within said internal straight cylinder volume, such as for example a sealed joint of rubber, polymer or soft metal. Advantageously, in the case of spraying with a spraying fluid with lubricating properties such as an oil, said rollers, said bearing members and the roll gap are lubricated by said spraying fluid. In this case, the bearing members have no sealing gaskets. Conversely, if the spraying fluid is based, for example, on an emulsion of rolling fluid in water, said bearing members are protected from said emulsion by said sealing gaskets, which are then able to keep said bearing members lubricated. In particular, said bearing members are lubricated using a grease for the bearing members retained by said sealing gaskets.

Advantageously, said bearing members are commercial ball, roller or needle bearings, sealed or otherwise depending on the lubricating qualities of the spraying fluid, in particular if this latter is for example respectively a water- or oil-based emulsion. As a variant to commercial bearings, said bearing members may be balls, rollers or needles arranged between said fixing and said sleeve of said roller, or directly between said fixed axis and said sleeve, in order to enable a rotation of said sleeve around said fixed axis. Advantageously, the use of non-commercial bearings saves space in the volume of said internal straight cylinder. This space saving can then be used to dimension the roll to withstand a pressure greater than that withstood when using a commercial bearing.

Particularly advantageously, the device according to the invention is characterized in that each roller can be pressurized with an internal gas pressure slightly higher than atmospheric pressure, for example using compressed air, in order to prevent the ingress and retention of fluid in the rollers, in particular fluids detrimental to lubrication of the bearing members.

In particular, the device according to the invention is characterized in that at least two nozzles are distributed substantially symmetrically, either in relation to a median plane of the strip, said median plane being equidistant from said axes of the working rolls and parallel to the strip, or in relation to the plane defined by said perpendicular plane, or in relation to a combination of the two planes, perpendicular and median. Advantageously, the symmetry defined by said symmetrical distribution of the nozzles guarantees an identical supply of lubricating and cooling fluid, either for each of said working rolls, or for one side of said working roll facing the entry of the strip and the other side of said roll facing the exit of the strip.

Furthermore the device according to the invention is characterized in that said nozzle system has at least one nozzle fixed to at least one support, or in particular an axial stop support, incorporating a bearing or otherwise, of one of said working rolls. Advantageously, the fixing of said nozzle to said support enables said spraying in an average direction substantially tangential to the axis of one of said working rolls, in particular forming said angle of between 0° and 15° with the axis of one of said working rolls.

In particular, the device according to the invention is characterized in that the nozzle system is able to spray at least one part of a spraying surface defined, according to a first geometry, by a strip-surface half-plane extending from one of said contact generatrices and a surface of the working roll between this contact generatrix and one of said bearing generatrices, such that said spraying surface is contained within an acute dihedral formed by a first half-plane corresponding to said strip surface half-plane extending from said same contact generatrix and a second half-plane extending from said same contact generatrix and comprising said bearing generatrix. Furthermore, in another variant, the device according to the invention is also characterized in that the nozzle system is able to spray at least one part of a spraying surface defined, according to a second geometry, by a surface of the working roll between one of its bearing generatrices and its support generatrix. Finally, according to a last variant, the device according to the invention is characterized in that the nozzle system is able to combine the spraying of spraying surfaces defined according to said first geometry and/or said second geometry.

In particular, the device according to the invention is characterized in that the nozzle system is able to simultaneously spray at least one part of at least two of said spraying surfaces defined according to at least one of said geometries. Equally, the device according to the invention is in particular characterized in that the nozzle system is able to simultaneously spray at least one part of at least two of said spraying surfaces defined according to at least one of said geometries.

More comprehensively, several spraying methods can be defined:

According to a first spraying method, the nozzle system is able to simultaneously spray at least one part of all of the spraying surfaces defined according to said first geometry, either in said average direction perpendicular to the longitudinal axis of said working roll, or in said average direction substantially tangential to said axis of said working roll.

According to a second spraying method, the nozzle system is able to simultaneously spray at least one part of all of the spraying surfaces according to said first geometry being for the most part on the same side of said perpendicular plane, either in said average direction substantially perpendicular to the longitudinal axis of said working roll, or in said average direction substantially tangential to the axis of said working roll. Advantageously, the second spraying method applies to continuous rolling, said sprayed part then being on the side of an entry of the rolled strip in the rolling stand.

According to a third spraying method, the nozzle system is able to simultaneously spray at least one part of all of the spraying surfaces defined according to said second geometry, either in said average direction substantially perpendicular to the longitudinal axis of said working roll, or in said average direction substantially tangential to the axis of said working roll.

According to a fourth method, the nozzle system is able to simultaneously spray at least one part of all of the surfaces defined according to said second geometry being for the most part on the same side of said perpendicular plane, either in said average direction substantially perpendicular to the longitudinal axis of said working roll, or in said average direction substantially tangential to the axis of said working roll.

According to a fifth method, the nozzle system is able to simultaneously spray at least one part of all of the surfaces defined according to said first and said second geometry and being for the most part on the same side of said perpendicular plane, either in said average direction substantially perpendicular to the longitudinal axis of said working roll, or in said average direction substantially tangential to the axis of said working roll.

According to a sixth method, the nozzle system is able to simultaneously spray at least one part of all of the surfaces defined according to said first geometry and being for the most part on one side of said perpendicular plane, as well as at least one part of all of the surfaces defined according to said second geometry and being for the most part on the other side of said perpendicular plane, either in said average direction substantially perpendicular to the longitudinal axis of said working roll, or in said average direction substantially tangential to the axis of said working roll.

Finally, according to a seventh method, the nozzle system is able to simultaneously spray at least one part of all of the surfaces defined according to said first and said second geometry, either in said average direction substantially perpendicular to the longitudinal axis of said working roll, or in said average direction substantially tangential to the axis of said working roll.

In particular, the device according to the invention is characterized in that the nozzle system is able to alternately spray said spraying surfaces defined according to at least one of said geometries. Advantageously, in the case of a reversible rolling stand, the nozzle system is able to combine an alternation of the spraying of said spraying surfaces with an alternation linked to the running direction of the strip. Effectively, when the strip is moving in a first direction, a first spraying is effected according to a first manner, then, when the running direction of the strip is reversed, a second spraying is effected according to a second manner, said second manner being defined such that said second spraying is substantially symmetrical to said first spraying in relation to said perpendicular plane. In particular, the switching from said first spraying to said second spraying is automatic when the running direction of the strip is reversed. Thus, the alternation of the spraying makes it possible, in relation to a reference linked to the rolling stand, to vary the spraying as a function of the running direction of the strip, such that, in relation to a reference linked to the running direction of the strip, the spraying remains substantially identical.

Finally, the device according to the invention is in particular characterized in that a flow rate control system is able to control and vary the spraying rate of at least one of said nozzles. Advantageously, this control and this variation of flow rate make it possible to adapt the flow rate of each nozzle of said spraying system as a function, for example, of a position or of a placement of the nozzle in the rolling stand, of a measurement of a temperature profile depending on the width of the strip or the length of the working roll. Thus, for a given nozzle, the flow rate of said nozzle can be varied over time in a controlled manner by said control system. In particular, the nozzles can be supplied by a single manifold or a plurality of manifolds enabling a split supply of fluid to the nozzles, by adjusting the flow rate of the fluid of each of the manifolds between zero and a maximum value. In a known manner, this split supply can be controlled by a member for measuring the transversal flatness of the rolled strip.

Exemplary embodiments and applications are provided using the following figures:

DESCRIPTION OF THE INVENTION

Figure 1:
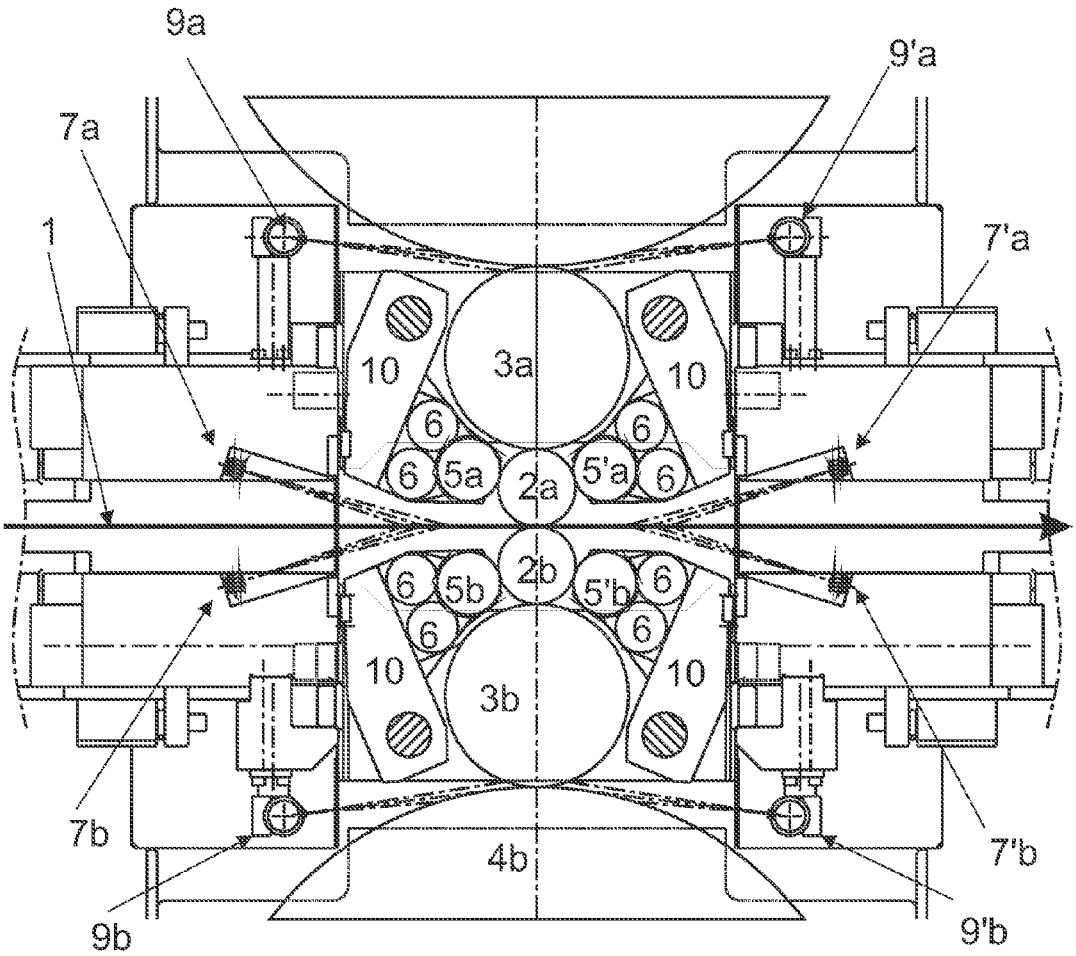
FIG. 1 Exemplary embodiment of a spraying device of a side-supported six-high rolling mill according to the prior art.

By way of example, FIG. 1 shows a spraying of a side-supported six-high rolling mill according to the prior art. The strip (1) moves between two working rolls (2*a*, 2*b*) supported vertically by a first pair of intermediate support rolls (3*a*, 3*b*), themselves supported vertically by a second pair of final support rolls (4*a*, 4*b*) bearing against said first pair of support rolls (3*a*, 3*b*). The working rolls (2*a*, 2*b*) are also supported laterally by two pairs of side bearing rolls (5*a*, 5*b*) on the strip entry side and (5'*a*, 5'*b*) on the exit side. Each of the side bearing rolls is itself supported laterally by two rows of bearing rollers (6), each row comprising a plurality of rollers arranged side by side along a common axis on a support (10) common to two rows.

Some spray nozzles (7*a*, 7*b*) distribute a fluid to lubricate the strip before it enters the roll gap and other nozzles (7'*a*, 7'*b*) distribute a fluid for cooling the strip after it leaves the roll gap. Other spray nozzles (9*a*, 9*a*', 9*b*, 9*b*') cool the intermediate and bearing rolls and, indirectly by conduction between the rolls, the working rolls.

Figure 2:
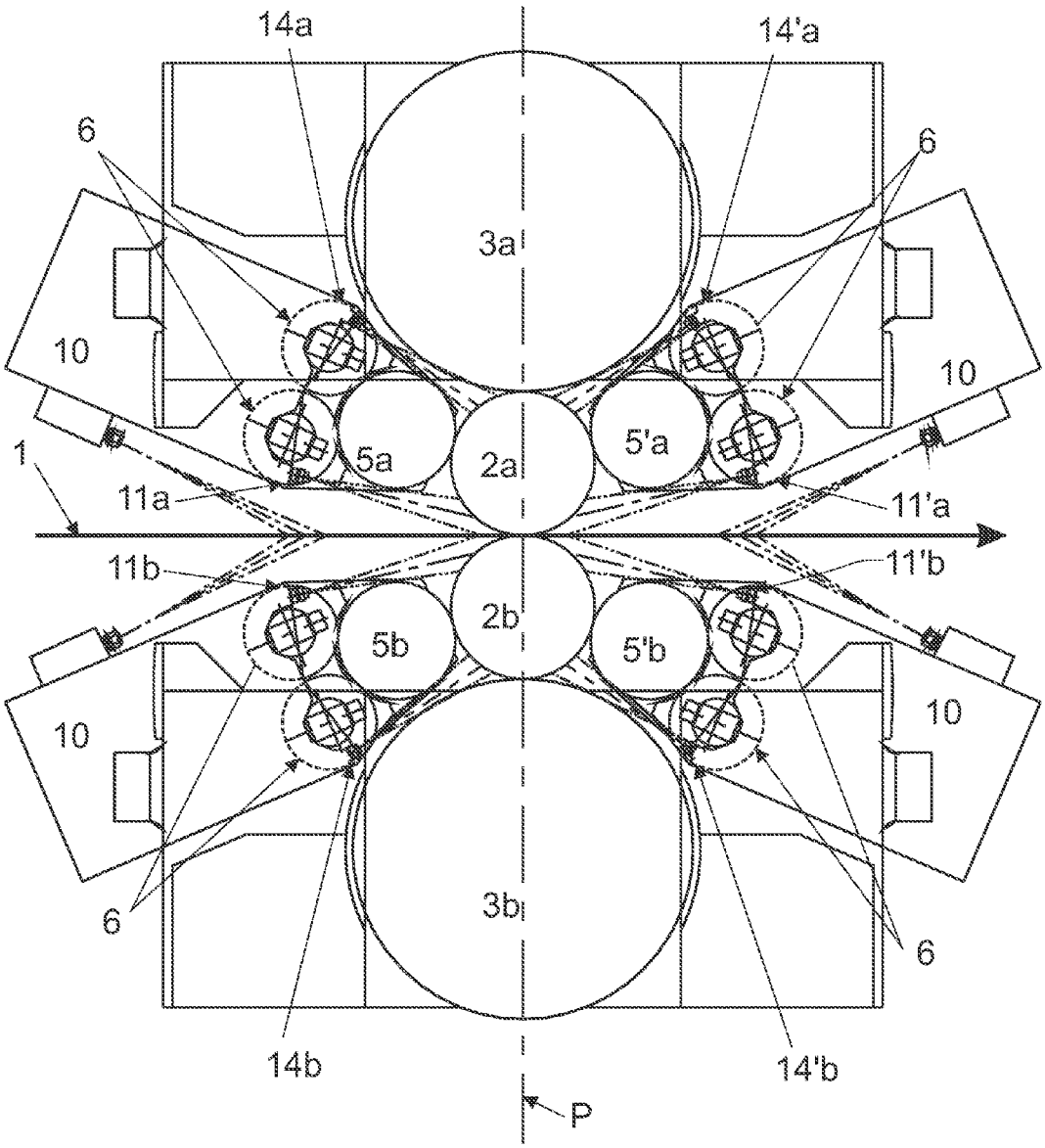
FIG. 2 Exemplary embodiment according to the invention of a spraying device of a side-supported six-high rolling mill characterized by a nozzle system inserted between the bearing rollers.

FIG. 2 shows a spraying of a respectively continuous or reversible rolling plant for a moving metal strip (1) comprising at least one respectively non-reversible or reversible rolling stand, said stand comprising:

- a pair of working rolls (2*a*, 2*b*) with parallel longitudinal axes between which said strip (1) moves, each one of said working rolls (2*a*, 2*b*) having at least one contact generatrix in contact with said strip (1),
- a plane perpendicular (P) to one running direction of the strip (1), in which are located at least one of said contact generatrices and the axes of said working rolls,
- at least one pair of support rolls (3*a*, 3*b*) with longitudinal axes parallel to the plane of the strip (1) that are located on either side of said strip (1), said support rolls and working rolls (2*a*, 2*b*) located on the same side of the strip being in contact with one another along a common support generatrix in order to transmit to the working rolls (2*a*, 2*b*) a rolling load substantially normal to the strip, said support rolls (3*a*, 3*b*) being themselves supported by final support rolls (not shown) such as the final support rolls (4*a*, 4*b*) shown in FIG. 1,
- two pairs of side bearing rolls (5*a*, 5'*a*, 5*b*, 5'*b*) with parallel longitudinal axes, said bearing rolls (5*a*, 5'*a*, 5*b*, 5'*b*) of a given pair being located, symmetrically or otherwise, on either side of one of said working rolls (2*a*, 2*b*) relative to said perpendicular plane (P), in a plane parallel to the strip (1) so that each of said bearing rolls of a given pair transmit along a bearing generatrix of said working roll (2*a*, 2*b*) a load making it possible to keep the axis of said working roll in a determined position relative to at least one of said support rolls (3*a*, 3*b*),
- a support of said bearing rolls (5*a*, 5'*a*, 5*b*, 5'*b*) by means of two rows formed of a plurality of bearing rollers (6) assembled side by side along a common axis on a support (10) common to two rows, said rollers (6) making it possible to keep said bearing rolls (5*a*, 5'*a*, 5*b*, 5'*b*) and working rolls (2*a*, 2*b*) in a determined position.
- at least one nozzle system enabling the spraying of at least one jet of fluid over at least one part of the strip and at least one part of one of said rolls, and is characterized in that at least one of said systems of nozzles is able to effect at least one direct spraying of at least one part of the working rolls (2*a*, 2*b*) on either side of said plane perpendicular (P) to the running direction of the strip.

According to at least one of the spraying methods described above, and according to a first spraying system, the spray nozzles (11*a*, 11*b*) inserted between said rollers (6) each distribute the spraying fluid in a respective dihedral. Effectively, at least one of said spray nozzles (11*a*) distributes the spraying fluid in the dihedral formed by a first incoming-strip surface half-plane extending from one of said contact generatrices of one of said working rolls (2*a*) and a second half-plane extending from the same contact generatrix and including said bearing generatrix of one of said working rolls (2*a*), such that the two half-planes and the nozzle (11*a*) are situated on the same side of the strip. Respectively, at least one other of said spray nozzles (11*b*) distributes the spraying fluid in the dihedral formed by another first incoming-strip surface half-plane extending from another of said contact generatrices of the other of said working rolls (2*b*) and another second half-plane extending from the same other contact generatrix and including said bearing generatrix of the other of said working rolls (2*b*), such that the two other half-planes and said other nozzle (11*b*) are situated on another same side of the strip.

According to a second spraying system, other nozzles (11'*a*, 11'*b*) each distribute the spraying fluid respectively in another dihedral on the exit side of the strip, such that the second spraying system and the surfaces sprayed are in particular substantially symmetrical to said first spraying system relative to said perpendicular plane (P).

Again, according to one of said spraying methods described above and according to a third spraying system, the spray nozzles (14*a*, 14*b*) each distribute the spraying fluid respectively in a respective dihedral. At least one of said spray nozzles (14*a*) distributes the spraying fluid in the dihedral formed by a first half-plane parallel to the incoming strip extending from one of said bearing generatrices of one of said working rolls (2*a*), and a second half-plane extending from the same bearing generatrix and including the support generatrix of the same working roll (2*a*), such that the two half-planes and the nozzle (14*a*) are situated on the same side of the strip. Respectively, at least one other of said spray nozzles (14*b*) distributes the spraying fluid in the dihedral formed by another first half-plane parallel to the incoming strip extending from another of said bearing generatrices of the other of said working rolls (2*b*) and another second half-plane extending from the same other bearing generatrix and including the support generatrix of the same other working roll (2*b*), such that the two other half-planes and said other nozzle (14*b*) are situated on another same side of the strip.

According to a fourth spraying system, other nozzles (14'*a*, 14'*b*) each distribute the spraying fluid respectively in another dihedral on the exit side of the strip, such that the fourth spraying system and the surfaces sprayed are in particular substantially symmetrical to said third spraying system relative to said perpendicular plane (P).

Other spray nozzles not shown cool the support rolls in a conventional manner. The nozzles are all assembled on the supports (10) of the rollers (6) in a fixing zone of said fixed axes passing all the way through said rollers.

Figure 3:
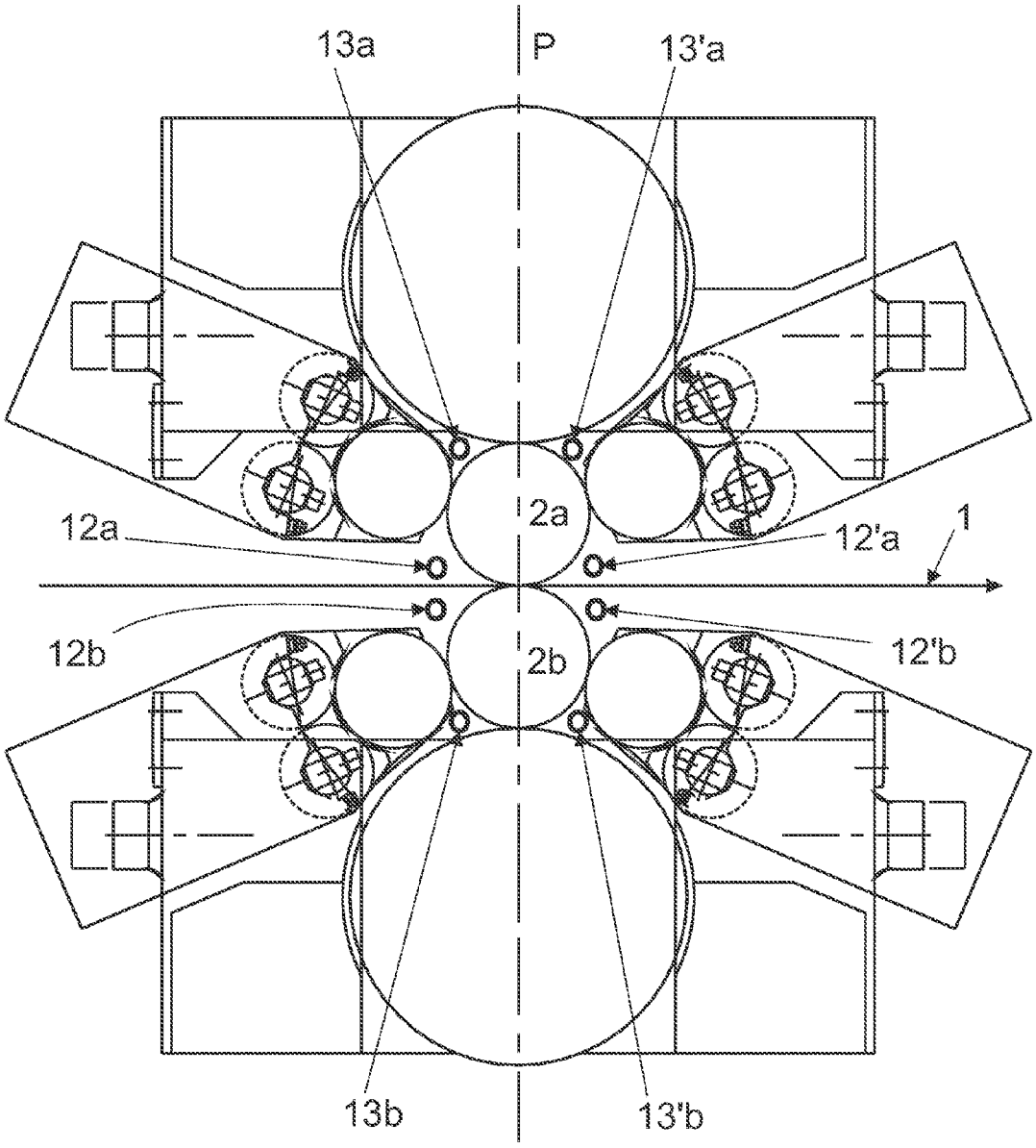
FIG. 3 Exemplary embodiment according to the invention of a spraying device of a side-supported six-high rolling mill with at least one nozzle system assembled on the supports of said working rolls.

FIG. 3 shows the spraying of a side-supported six-high rolling mill, differing from the spraying shown in FIG. 2 only in that said spraying can also be effected by at least one nozzle system assembled on at least one support of said working rolls (2*a*, 2*b*). In this case, nozzles or groups of spray nozzles can in particular be installed directly close to at least one of the bearings or one of the axial stop supports of said working rolls (2*a*, 2*b*), on either side of said perpendicular plane (P). In particular, according to a fifth spraying system, at least two spray nozzles (12*a*, 12*b*) each distribute the spraying fluid in a respective dihedral. Effectively, at least one of said spray nozzles (12*a*) distributes the spraying fluid in the dihedral formed by a first incoming-strip surface half-plane extending from one of said contact generatrices of one of said working rolls (2*a*) and a second half-plane extending from the same contact generatrix and including said bearing generatrix of one of said working rolls (2*a*), such that the two half-planes and the nozzle (12*a*) are situated on the same side of the strip. Respectively, at least one other of said spray nozzles (12*b*) distributes the spraying fluid in the dihedral formed by another first incoming-strip surface half-plane extending from another of said contact generatrices belonging to the other of said working rolls (2*b*) and another second half-plane extending from the same other contact generatrix and including said bearing generatrix of the other of said working rolls (2*b*), such that said two other half-planes and said other nozzle (12*b*) are situated on another single side of the strip.

According to a sixth spraying system, other spray nozzles (12'*a*, 12'*b*) each distribute the spraying fluid respectively in another dihedral on the exit side of the strip, such that the sixth spraying system and the surfaces sprayed are in particular substantially symmetrical to said fifth spraying system relative to said perpendicular plane (P).

Furthermore, according to a seventh spraying system, at least two spray nozzles (13*a*, 13*b*) each distribute the spraying fluid respectively in a respective dihedral. At least one of said spray nozzles (13*a*) distributes the spraying fluid in the dihedral formed by a first half-plane parallel to the incoming strip extending from one of said bearing generatrices of one of said working rolls (2*a*), and a second half-plane extending from the same bearing generatrix and including the support generatrix of said working roll (2*a*), such that the two half-planes and the nozzle (13*a*) are situated on the same side of the strip. Respectively, at least one other of said spray nozzles (13*b*) distributes the spraying fluid in the dihedral formed by another first half-plane parallel to the incoming strip extending from another of said bearing generatrices of the other of said working rolls (2*b*) and another second half-plane extending from the same other bearing generatrix and including the support generatrix of the other of said working rolls (2*b*), such that the two other half-planes and said other nozzle (13*b*) are situated on another same side of the strip.

Moreover, according to an eighth spraying system, other nozzles (13'*a*, 13'*b*) each distribute the spraying fluid respectively in another dihedral on the exit side of the strip, such that the eighth spraying system and the surfaces sprayed are in particular substantially symmetrical to said seventh spraying system relative to said perpendicular plane (P).

The orientation of the nozzles according to the fifth, sixth, seventh and eighth spraying systems is such that the spraying fluid is injected onto the working rolls (2*a*, 2*b*) and/or onto the strip (1) at an angle of between 0° and 15° in relation to the axis of said working rolls (2*a*, 2*b*), while the orientation of the nozzles according to the first, second, third and fourth spraying systems is such that the spraying fluid is injected onto the working rolls (2*a*, 2*b*) and/or onto the strip (1) in an average direction substantially perpendicular to the axes of said working rolls. Furthermore, and advantageously, the nozzles (12*a*, 12*b*, 12'*a*, 12'*b*, 13*a*, 13*b*, 13'*a*, 13'*b*) forming the fifth to eighth spraying system, can be assembled on one of the supports of one of the extremities of said working rolls (2*a*, 2*b*), in particular, on each of the supports supporting each of the extremities of said working rolls, or even near to said extremities, for example in the vicinity or on an axial stop support of one of said extremities of one of said working rolls. Furthermore, said nozzles (12*a*, 12*b*, 12'*a*, 12'*b*, 13*a*, 13*b*, 13'*a*, 13'*b*) forming the fifth to eighth spraying system are at least in part arranged substantially symmetrically in relation to other nozzles, assembled on another support of said working rolls (2*a*, 2*b*), in particular in the vicinity of said support or of the extremity of said axis of the working roll, said other support holding the other extremities of said working rolls (2*a*, 2*b*).

Figure 4:
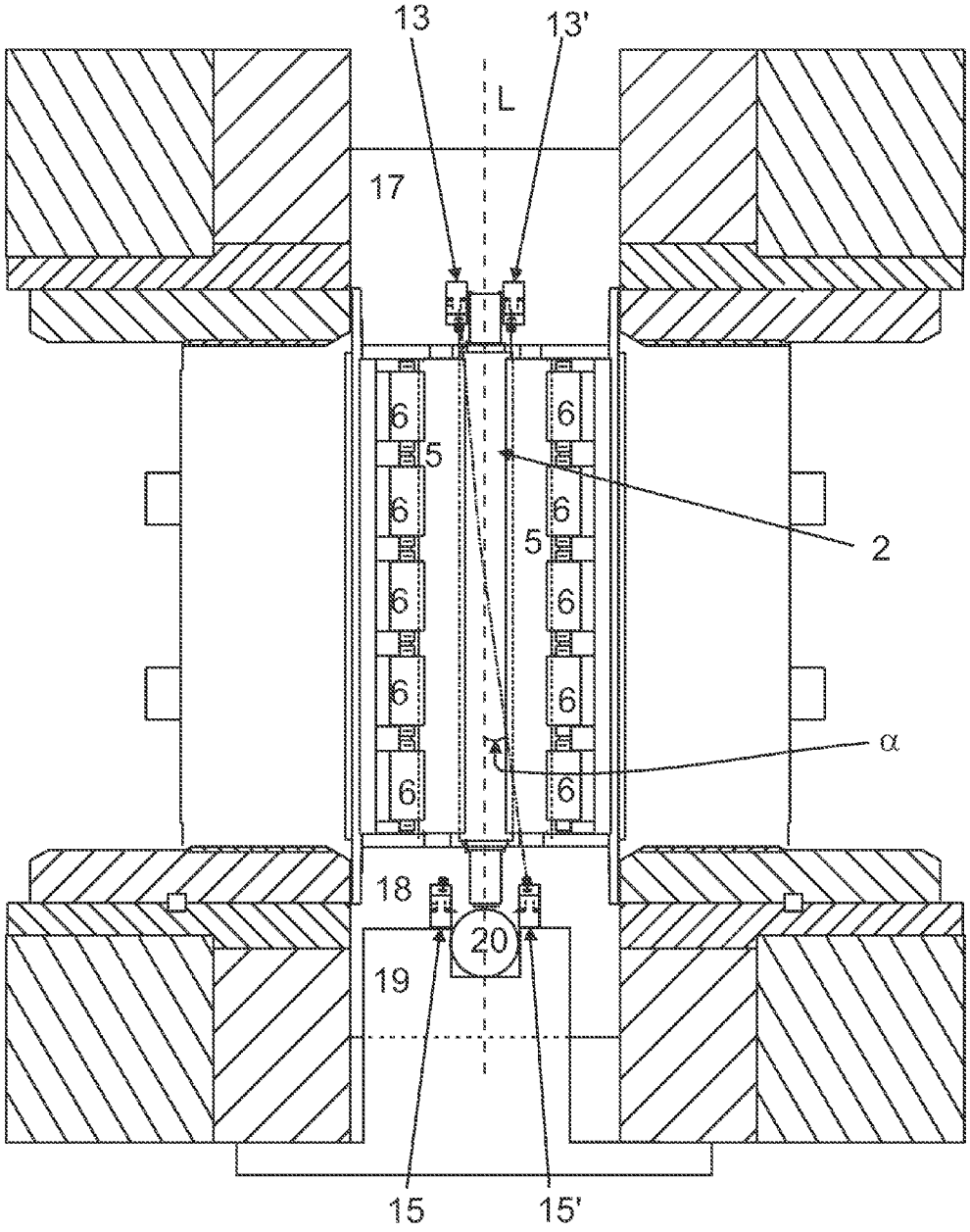
FIG. 4 Exemplary embodiment according to the invention of a spraying device of a side-supported six-high rolling mill, comprising at least one spraying of the working rolls at an angle of between 0° and 15° from the axis of said working rolls.

FIG. 4 shows an exemplary arrangement of the spray nozzles for a six-high rolling mill supported laterally by bearing rollers (6) supporting the side bearing rolls (5), each of said nozzles being able to spray at least one of said working rolls (2) at an alpha angle ($\alpha$) of between 0° and 15° from the longitudinal axis (L) of rotation of said working rolls (2). Preferably, a vicinity of the extremities of the working rolls (2) has for each of said working rolls, at least one spraying system comprising one or more nozzles (13, 13', 15, 15') able to spray said working rolls (2) using jets of spray fluid aimed along the length of said working rolls (2), such that said nozzle jets, whose nozzles face one another and are located at two different extremities of one of said working rolls, are jets in opposing directions, in particular symmetrical, and that make it possible to spray firstly some parts of said working rolls (2) close to the strip and, secondly, some parts of said working rolls (2) close to said support rolls, the direction of said jet forming angles of between 0° and 15° from the longitudinal axis (L) of rotation of said working rolls (2). Vicinity of the extremities of the working rolls refers non-exhaustively to each of the supports (17, 18) of said working rolls, to the area around an axial stop (20) or a bearing of one of said working rolls, or advantageously to an axial stop support (19) that already has a lubrication system to lubricate the bearing members of the working rolls and which can be modified to supply one of said systems of nozzles able to spray said working rolls in a direction substantially tangential to the axis of said working rolls.

Furthermore, at least a first spraying can advantageously be complemented by at least a second spraying. Said first spraying is effected by a first nozzle (15) assembled in the vicinity of one of the extremities of one of said working rolls (2), said first nozzle (15) spraying at least one first part of a surface of said working roll (2), said first part being for the most part on one side of said perpendicular plane (P) and being either contained between a first contact generatrix belonging to the strip surface plane and a first bearing generatrix, or between said first bearing generatrix and said support generatrix of said roll. Said second spraying is then effected by a second nozzle (13') assembled in the vicinity of the other extremity of said working roll (2), said second nozzle (13') spraying at least a second part of a surface of said working roll (2), said second part being for the most part on the other side of said perpendicular plane (P) and being either contained within a second contact generatrix belonging to the strip surface plane and a second bearing generatrix, or between said second bearing generatrix and said support generatrix of said working roll (2). Advantageously, according to this configuration defined by said first and said second spraying, a nozzle assembled for example on a bearing on one side of the perpendicular plane (P) and another nozzle assembled on an opposing bearing on the other side of the perpendicular plane (P) are able to supply a spraying making it possible to prevent the creation of cooling gradients along the working roll in question.

Figure 5:
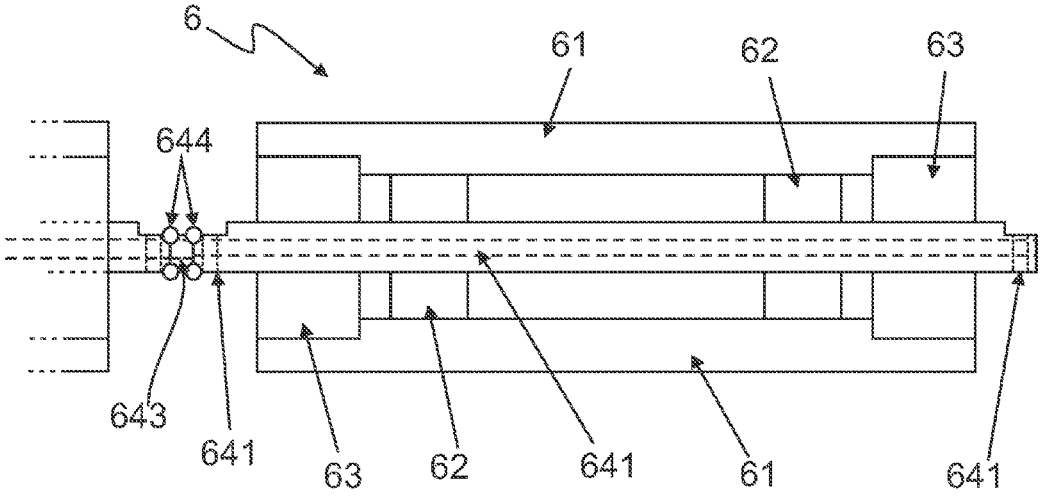
FIG. 5 Exemplary embodiment of the bearing rollers according to the invention.

FIG. 5 shows an exemplary embodiment of a bearing roller (6) designed for implementation of the device according to the invention. A cylindrical sleeve (61) has at each of its extremities a ball or roller or needle bearing member (62) and possibly a sealing gasket (63) not extending beyond the total space occupied by said sleeve. The rollers are fixed to the roller supports (10) that transmit the lateral loads from the rolling to the structure of the rolling mill via an axis (64) passing completely through the roller supporting the bearing members (62) and that is assembled on the supports, at each of its two extremities, in particular by a bolt passing through a fixing hole (641). The spray nozzles are assembled on the roller supports (10) level with the assembly zones of the roller axes (64) to said supports (10), such that at least one of said nozzles is positioned at each fixing of said roller axis (64) to said support (10). Furthermore and in particular, an axial channel (642) for the circulation of compressed air passes through the axis along its length and distributes the compressed air to the bearing members (62) and the sealing gaskets (63) through radial channels that are not shown. A compressed-air sealing member (644) is assembled between the two neighboring extremities of two consecutive rollers. A bushing (643) may be used to ensure the continuity of the axial channel (642) between two rollers.

Figure 6:
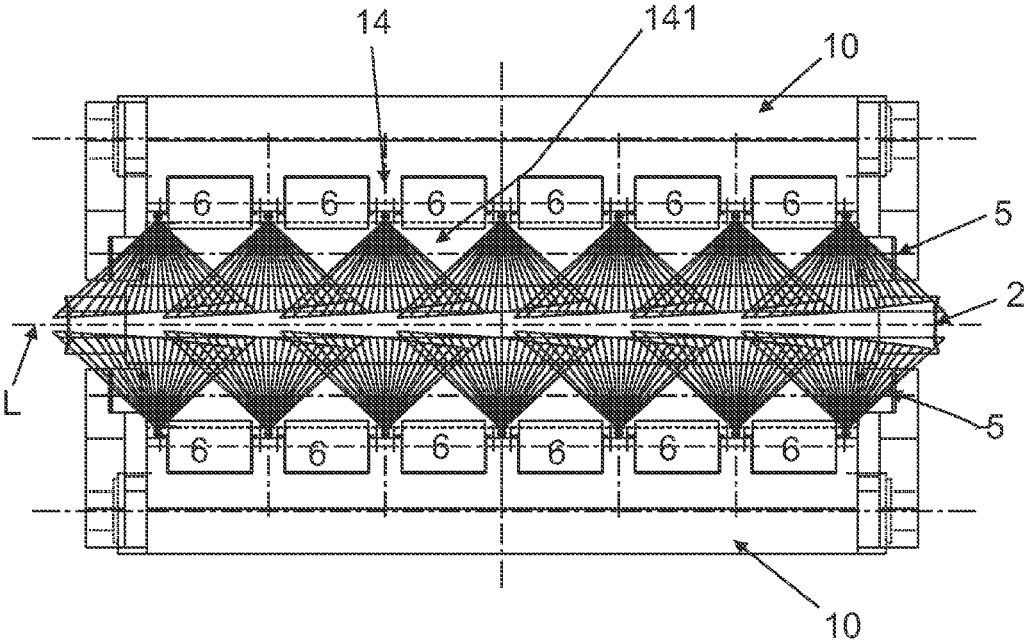
FIG. 6 Exemplary embodiment of spraying device substantially perpendicular to a working roll according to the invention.

FIG. 6 shows an exemplary embodiment, according to the invention, of the spraying device substantially perpendicular to one of said working rolls. It is more specifically the assembly of a line or row of bearing rollers (6) according to the invention. Two side bearing rolls (5) support a working roll (2) and are themselves supported by two rows of bearing rollers (6). To a support (10) are attached rollers (6) and nozzles, for example the nozzle (14) whose jet (141) sprays a spraying fluid on at least one part of the surface of one of said working rolls (2). Each of said nozzles fixed level with the fixing to the roller support (10) of the axis of said rollers is able to spray one of said rolls, in particular in a direction substantially perpendicular to the longitudinal axis of rotation (L) of one of said working rolls (2).

In summary, the method and the device according to the invention provide several advantages over existing methods or devices in that:

- they provide at least one direct spraying of the working rolls using jets of spraying fluid for a side-supported six-high rolling plant,
- they enable a spraying using spray nozzles whose jet is substantially perpendicular to the axis of the working rolls,
- they enable a spraying using spray nozzles whose jet is substantially parallel to the axis of the rolls, i.e. whose jet direction forms in particular an angle of between 0° and 15° with each of said axes of the working rolls,
- they enable an injection of spraying fluid directly and simultaneously over several parts of said working rolls, thus optimizing the lubrication and cooling of said rolls,
- they make it possible to spray the working rolls of a reversible or non-reversible side-supported six-high rolling mill,
- they reduce the distance between the nozzles and the surface of the working rolls, thereby guaranteeing more consistent jets that ensure a more powerful impact against the surface of said working rolls and that thereby facilitate the heat exchange,
- they make it possible, on account of the fact that the spray nozzles can be mounted on the supports of said rollers, to move the spray nozzles simultaneously with said rollers as a function of the wear of the working rolls and therefore of the correlative movement of the roller supports without having to adjust their positions,
- they enable a split supply of the nozzles, in particular via manifolds,
- they enable the flow rate of the nozzles to be adjusted as a function of their position in the rolling mill and/or measurements of temperature profiles of the strip,
- they make it possible to improve the processing quality of the rolled metal strip.

The invention claimed is:

1. A spraying method for a rolling plant for rolling a strip, the method which comprises:

rolling the strip between a pair of working rolls with mutually parallel roller axes, the strip being engaged between said working rolls and moving between said pair of working rolls along a plane of movement parallel to said roller axes, each of the working rolls having at least one contact generatrix in contact with the strip;

transmitting to the working rolls a rolling load substantially normal to the strip, with a pair of support rolls disposed in contact with the working rolls along a common support generatrix in order to transmit a rolling load to the working rolls, wherein at least one of said contact generatrices and the axes of said working rolls are in a perpendicular plane extending perpendicularly to the plane of movement of the strip;

supporting each of the working rolls with a pair of bearing rolls located on either side of the perpendicular plane, each of the bearing rolls being configured to exert, along a bearing generatrix of the working roll, a load keeping the axis of the respective working roll in a position determined in relation to the rolling stand and to the bearing rolls; and spraying at least one part of the strip with at least one nozzle system and directly spraying at least one part of the working rolls on either side of the perpendicular plane.

2. The method according to claim 1, which comprises directing the spray in an average direction substantially perpendicular to the axis of the working roll.

3. The method according to claim 1, which comprises directing the spray in an average direction substantially tangential to the working roll.

4. The method according to claim 1, which comprises spraying, for at least one of the working rolls, at least one part of a spraying surface defined, according to a first geometry, by a strip-surface half-plane extending from one of the contact generatrices and a surface of the working roll between this contact generatrix and one of the bearing generatrices, such that the spraying surface is contained within an acute dihedral formed by a first half-plane corresponding to the strip surface half-plane extending from the contact generatrix and a second half-plane extending from that same contact generatrix and comprising the bearing generatrix.

5. The method according to claim 4, which comprises spraying, for at least one of said working rolls, at least one part of a spraying surface defined, according to a second geometry, by a surface of the working roll contained within one of its bearing generatrices and its support generatrix.

6. The method according to claim 4, which comprises simultaneously spraying at least two of the spraying surfaces defined according to at least one of the first and second geometries.

7. The method according to claim 4, which comprises alternating the spraying of the spraying surfaces defined according to at least one of the geometries.

8. The method according to claim 1, which comprises varying a spraying rate.

9. A spraying device for a plant for rolling a strip, the plant having at least one rolling stand, comprising:

a pair of working rolls with mutually parallel axes between which the strip moves along a strip travel direction, each one of said working rolls having at least one contact generatrix in contact with said strip;

wherein at least one of said contact generatrices and the axes of said working rolls are included in a perpendicular plane extending perpendicularly to the strip travel direction;

at least one pair of support rolls with axes parallel to the plane of said strip disposed on either side of said strip, said support rolls and working rolls located on a same side of said strip being in contact with one another along a common support generatrix in order to transmit to said working rolls a rolling load substantially normal to the strip;

two pairs of bearing rolls with mutually parallel axes, said bearing rolls of a given pair being located symmetrically on either side of one of said working rolls in a plane parallel to the strip such that each of said bearing rolls of a given pair is able to transmit along a bearing generatrix of said working roll a load enabling the axis of said working roll to be kept in a determined position relative to said support roll;

a support of said bearing rolls by means of two rows formed of a plurality of bearing rollers assembled side by side, enabling said bearing rolls and working rolls to be maintained in a determined position; and one or more nozzle systems with nozzles configured to spray at least one jet of fluid over at least one part of the strip and at least one part of one of said rolls, with at least one of said nozzle systems being able to effect a direct spraying of at least one part of the working rolls on either side of said perpendicular plane extending perpendicularly to the travel direction of the strip.

10. The device according to claim 9, wherein said at least one nozzle system is able to spray at least one part of one of said working rolls in a direction substantially perpendicular to said axis of the working roll.

11. The device according to claim 9, wherein said nozzle system has a plurality of nozzles inserted between said bearing rollers.

12. The device according to claim 9, wherein said bearing rollers have an active bearing surface comprising an external cylindrical surface of a steel sleeve configured to receive, at each extremity of its internal cylindrical surface, at least one bearing member strictly contained within a straight cylindrical volume formed by said internal cylindrical surface.

13. The device according to claim 12, wherein a fixing of the bearing rollers is at least provided by an axis passing completely through said rollers and supporting each bearing member.

14. The device according to claim 12, wherein said bearing rollers are provided with at least one sealing gasket able to keep said bearing members lubricated.

15. The device according to claim 9, wherein each roller can be pressurized.

16. The device according to claim 9, wherein said nozzle system is configured to spray one part of said working roll in an average direction substantially tangential to said axis of the working roll.

17. The device according to claim 9, wherein said nozzle system has at least one nozzle fixed to at least one support of one of said working rolls.

18. The device according to claim 9, wherein at least two nozzles are distributed substantially symmetrically in relation to a median plane of the strip, said plane being equidistant from said axes of the working rolls.

19. The device according to claim 9, wherein at least two nozzles are distributed substantially symmetrically in relation to the plane defined by said perpendicular plane.

20. The device according to claim 9, wherein said at least one nozzle system is configured to spray at least one part of a spraying surface defined, according to a first geometry, by a strip-surface half-plane extending from one of said contact generatrices and a surface of the working roll between the contact generatrix and one of said bearing generatrices, such that said spraying surface is contained within an acute dihedral formed by a first half-plane corresponding to said strip surface half-plane extending from said same contact generatrix and a second half-plane extending from said same contact generatrix and comprising said bearing generatrix.

21. The device according to claim 20, wherein said at least one nozzle system is configured to spray at least one part of a spraying surface defined, according to a second geometry, by a surface of the working roll between one of its bearing generatrices and its support generatrix.

22. The device according to claim 21, wherein said at least one nozzle system is configured for simultaneously spraying at least one part of at least two of said spraying surfaces defined according to at least one of said first and second geometries.

23. The device according to claim 21, wherein said at least one nozzle system is configured to alternately spray said spraying surfaces defined according to at least one of said first and second geometries.

24. The device according to claim 9, which further comprises a flow rate control system configured to control and vary a spraying rate of at least one of said nozzles of said nozzle system.

* * * * *